United States Patent [19]

Tsai

[11] Patent Number: 4,836,964

[45] Date of Patent: Jun. 6, 1989

[54] METHOD OF PRODUCING A BOW HOLDING HANDLE

[76] Inventor: Son-Kung Tsai, No. 1, 77 Alley, 71 Lane, 2 Sec. Fu Hsing Rd., Taichung, Taiwan

[21] Appl. No.: 266,348

[22] Filed: Nov. 1, 1988

Related U.S. Application Data

[63] Continuation of Ser. No. 70,874, Jul. 2, 1987, abandoned.

[51] Int. Cl.[4] ..... B29C 67/22

[52] U.S. Cl. ..... 264/46.7; 264/46.4; 264/278

[58] Field of Search ..... 264/45.1, 46.4, 278, 264/46.7

[56] References Cited

U.S. PATENT DOCUMENTS

| | | | |
|---|---|---|---|
| 3,339,609 | 9/1967 | Cushman | 264/278 |
| 3,478,134 | 11/1969 | Gruss et al. | 264/46.4 |
| 4,061,520 | 12/1977 | Cecka et al. | 264/45.1 |

FOREIGN PATENT DOCUMENTS

| | | | |
|---|---|---|---|
| 58-185235 | 10/1983 | Japan | 264/46.4 |

*Primary Examiner*—Jan H. Silbaugh

*Assistant Examiner*—Allan R. Kuhns

*Attorney, Agent, or Firm*—Browdy and Neimark

[57] ABSTRACT

A method of producing a bow holding handle by providing a first mold cavity in the same shape as said bow holding handle but in smaller size; placing required parts of said bow holding handle in corresponding positions of said first mold cavity; sealing said first mold cavity; injecting liquid foam plastic into said first mold cavity; activating said plastic foam to cause expansion thereof and form a core of said bow holding handle as the same shape of said first mold cavity; removing said core away from said first mold cavity; wrapping said core with a plurality of layers of fiber reinforced plastics; providing a second mold cavity shaped in the form of said bow holding handle; inserting said wrapped core into said second mold cavity; sealing said second mold cavity; heating said second mold to cure said layers of fiber reinforced plastic and to cause re-expansion of said core for generating pressure within said second mold cavity pressing said core against said layers of fiber reinforced plastic and thereby provide intimate bonding of said core and said layers; and removing said wrapped core away from said second mold cavity as an integral fiber reinforced plastic bow holding handle.

1 Claim, 3 Drawing Sheets

METHOD OF PRODUCING A BOW HOLDING HANDLE

This application is a continuation, of application Ser. No. 070,874, filed July 2, 1987; now abandoned.

BACKGROUND OF THE INVENTION

The invention relates to a method of producing a bow holding handle, and more particularly to a method of producing a fiber reinforced plastic bow holding handle.

In earlier days, the bow holding handle was made of casting metal. The producing process was the same as that of metal casting without any particulars. Such holding handle has sufficient strength but it is too heavy so that fatigue or shakes usually happened to an archer's arm affecting shooting precision. Recently, fiber reinforced plastic was used as the material to form the bow holding handle by injection molding which reduced weight to a certain extent but was not completely satisfactory. As the related parts for such bow holding handle portions were installed after its formation by injection, its surface structure was affected and additional labor was needed. Furthermore, as such two kinds of bow holding handles were made of hard material, it caused vibration during shooting. Consequently, it caused arrow shaking at the instantaneous moment of shooting causing loss of precision.

SUMMARY OF THE INVENTION

The primary object of the present invention is to provide a method of producing a bow holding handle which simplified the process of producing that no additional labor is needed for installation of related parts and the formed product weight is lighter than above-mentioned kinds.

Another object of the present invention is to provide a method of producing a bow holding handle with products having characteristics of shock absorption.

In accordance with the present invention, a method of producing a bow holding handle comprising the step of providing a first mold cavity having the same shape as said bow holding handle but in smaller size; placing required parts of said bow holding handle in corresponding positions of said first mold cavity; sealing said first mold cavity; injecting liquid foam plastic into said first mold cavity; activating said liquid foam plastic to cause expansion thereof and to form a core of said bow holding handle as the same shape of said first mold cavity; removing said core of said bow holding handle away from said first mold cavity; wrapping said core of said bow holding handle with a plurality of layers of fiber reinforced plastic; providing a second mold cavity corresponding the shape of said bow holding handle; inserting said wrapped core of said bow holding handle into said second mold cavity; sealing said second mold cavity; heating said second mold cavity to cure said layers of fiber reinforced plastic and to cause re-expansion of said core for generating pressure within said second mold cavity pressing said core against said layers of fiber reinforced plastic and thereby provide intimate bonding of said core to said layers; and removing said warpped core from said second mold cavity as an integral fiber reinforced plastic bow holding handle.

BRIEF DESCRIPTION OF THE DRAWINGS

To enable the present invention to be fully understood; a preferred embodiment will now be described with reference to the following drawings, in which.

DETAILED DESCRIPTION OF THE PREFERRED EMBODIMENT

Figure 1:
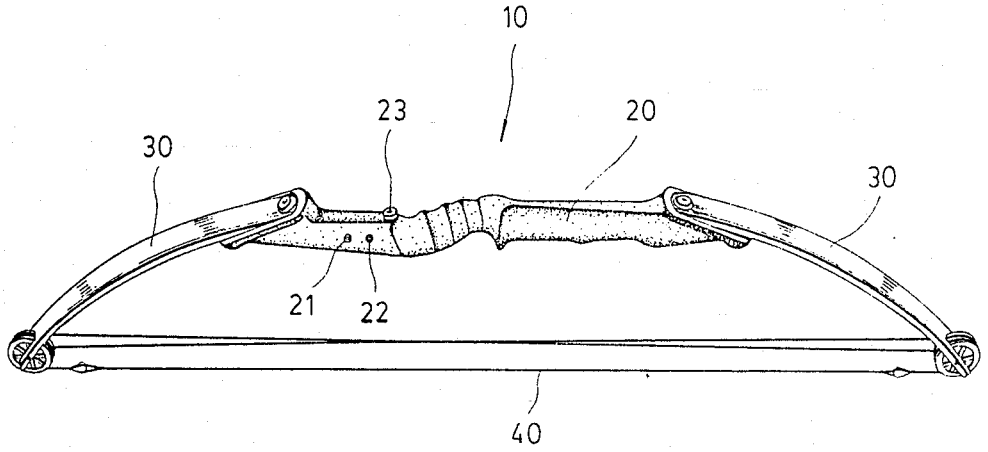
FIG. 1 is a perspective view of a bow.

Referring now to FIG. 1, the bow 10 consists of a holding handle 20 connected with a bow body 30 at both ends. The chard 40 fastened to said bow body 30. The holding handle 20 must have some nuts 21, 22, and 23 for connection with quiver, mount bracket and other devices.

Figure 2:
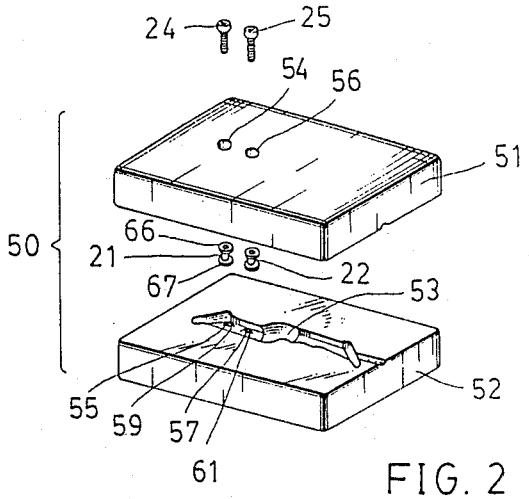
FIG. 2 is an exploded perspective view showing a first mold having a cavity in the same shape as a bow holding handle but in smaller size.

Referring to FIG. 2, a first mold 50 is provided including a cavity 53 formed by a upper and lower portions 51,52. The cavity 53 is in the same shape as the holding handle 20 but in smaller size. Holes 54, 55, 56 and 57 are provided at the position of the upper and lower portions 51, 52 of the first mold 50 corresponding the nuts 21, 22 of the bow holding handle 20.

Two bolts 24, 25 are provided penetrating through the holes 54, 56 from the outside of the upper portion 51 to the holes 55, 57 of the lower portion 52. In the producing process, the nuts 21, 22 are placed in the cavity 53 and bolted by the bolts 24, 25. At the end near the cavity 53, the holes 54, 55, 56 and 57 are provided with convex ring edges 58, 59, 60 and 61.

Figure 3:
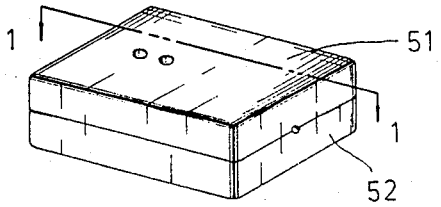
FIG. 3 is a perspective view of the closed first mold to inject liquid foam plastic.
Figure 4:
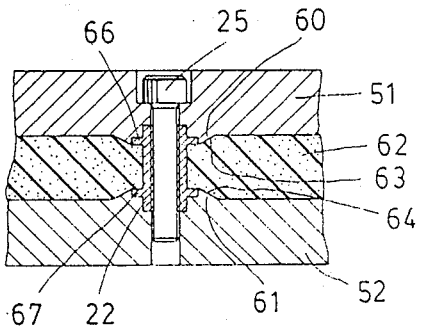
FIG. 4 is an elongated sectional view taken along line 1—1 of FIG. 3.
Figure 5:
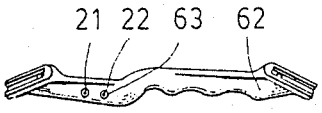
FIG. 5 is a perpective view of the core of the bow holding handle by the present invention.

Referring to FIG. 3, FIG. 4 and FIG. 5, the upper and lower portions 51, 52 of the first mold 50 are closed with a predetermined pressure. Then the liquid foam plastic is injected into the cavity 53 of the first mold 50 and heated to a predetermined temperature. The liquid foam plastic thus expands to press the wall surface of the cavity 53 and to form a core 62 of the bow holding handle 20. When the core 62 is formed, the corresponding positions of the core 62 are pre-set with nuts 21, 22 of which both upper and lower flanges abut concave surfaces 63, 64 to engage with the convex ring edges 58, 59, 60, 61.

Figure 6:
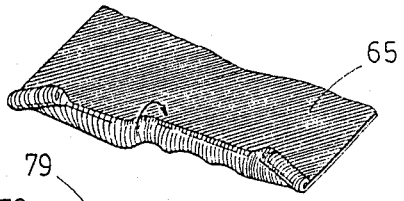
FIG. 6 illustrates the core being wrapped with a plurality of layers of fiber reinforced plastic.

Referring to FIG. 6, the core 62 of the bow holding handle is removed from the cavity 53 of the first mold 50 and wrapped with a plurality of layers of fiber reinforced plastic 65.

Figure 7:
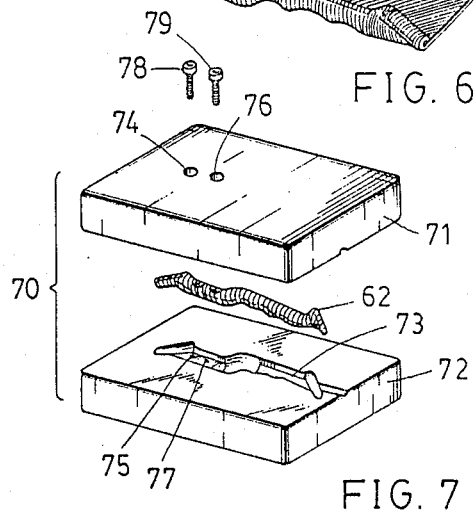
FIG. 7 is an exploded perspective view showing a second mold having a cavity corresponding substantially to the size and shape of the bow holding handle.

Referring to FIG. 7, a second mold 70 is provided which includes a cavity 73 formed by upper and lower portions 71, 72. The cavity 73 corresponds substantially to the size and shape of the bow holding handle 20. Holes 74, 75, 76 and 77 are provided at the positions of the upper and lower portions 71, 72 of the second mold 70 corresponding to the nuts 21, 22 of the bow holding handle 20.

Figure 8:
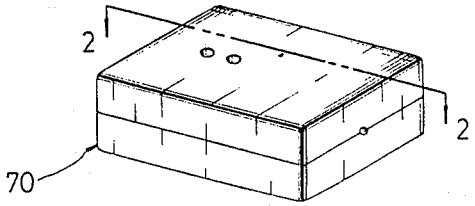
FIG. 8 is a perpective view of the closed second mold with a wrapped core therein.
Figure 9:
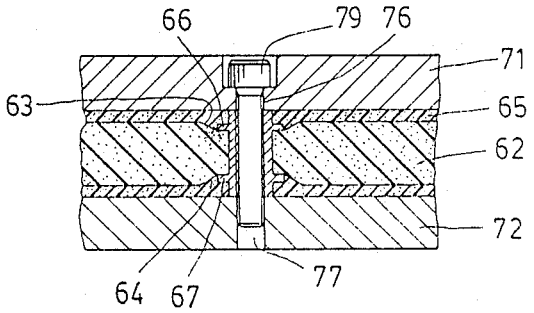
FIG. 9 is an elongated sectional view taken along line 2—2 of FIG. 8.
Figure 10:
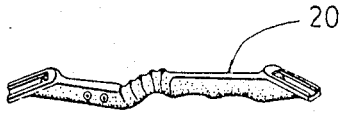
FIG. 10 is a perspective view of the bow holding handle produced by the present invention.

Referring to FIG. 8–FIG. 10, the wrapped core 62 with pre-set nuts 21, 22 is inserted into the cavity 73 of the second mold 70 and bolted by two bolts 78, 79 penetrating through the holes 74, 75, 76 and 77 of the upper and lower portions 71, 72 and then the mold 70 is closed with a predetermined pressure and heated to a predetermined temperature such as, for example, 150° C. and maintained at that temperature for 20–60 minutes. In the meantime, the core 62 is expanded to force the outer layers 65 of the bow holding handle 20 to intimately contact with the inner surface of the cavity 73. Thus, the cured outer layers of the fiber reinforced plastic take the shape of the cavity 73. Finally, the mold 70 is cooled to room temperature and the bow holding handle 20 is finished as showing in FIG. 10.

It should be noted that flanges 66, 67 are provided at the upper and lower ends of the nuts 21, 22, so that the nuts 21, 22 are quite steady by virtue of the stop of the shoulder formed by the flanges 66, 67 and the fiber reinforced plastic layer at the concave portions 63, 64.

It should be also noted that by using the production process of the present invention, the following distinctive features are obtained:

1. The bow holding handle has a lighter weight than that made of casting metal or made of fiber reinforced plastic by injection molding;
2. As the related parts are pre-set, the production process is simplified and the overall structure of the bow holding handle will not be damaged;
3. As inner pressure is generated during the process of producing, the out layers of the bow holding handle can have a smooth surface so as to reduce the time for surface rework;
4. The related parts and the bow holding handle have a very satisfactory connection strength and precise positioning;
5. By the size and material of the core, the weight of the bow holding handle can be adjusted.

I claim:

1. A method for producing a bow holding handle comprising the steps of:

(a) providing a first mold cavity having the same shape as said bow holding handle but in smaller size;

(b) placing a plurality of nuts into corresponding positions of said first mold cavity, each of said plurality of nuts including flanges at both ends thereof which engage with convex portions in a wall surface of said first mold cavity;

(c) sealing said first mold cavity (d) injecting liquid foamable plastic into said first mold cavity;

(e) activating said liquid foam plastic to cause expansion thereof and to form a core of said bow holding handle having the same shape of said first mold cavity, said core having a plurality of concave portions which engage said convex portions;

(f) removing said core of said bow holding handle away from said first mold cavity;

(g) wrapping said core of said bow holding handle with a plurality of layers of fiber reinforced plastic;

(h) providing a second mold cavity corresponding the shape of said bow holding handle;

(i) inserting said wrapped core of said bow holding handle into said second mold cavity;

(j) sealing said second mold cavity;

(k) heating said second mold cavity to cure said layers of fiber reinforced plastic and to cause re-expansion of said core for generating pressure within said second mold cavity pressing said core against said layers of fiber reinforced plastic to thereby provide intimate bonding of said core to said layers; and (l) removing said wrapped core from said second mold cavity as an integral fiber reinforced plastic bow holding handle wherein when the handle is removed, the flanges of each of the plurality of nuts is fixed between the concave portions of the core and the fiber reinforced plastic layer thereby securely fixing the nuts in position in the handle.

* * * * *